US009840947B2

(12) United States Patent
Kohrs et al.

(10) Patent No.: US 9,840,947 B2
(45) Date of Patent: Dec. 12, 2017

(54) CAMSHAFT ADJUSTING DEVICE

(71) Applicant: Schaeffler Technologies AG & Co. KG, Herzogenaurach (DE)

(72) Inventors: Mike Kohrs, Oberreichenbach (DE); Jens Schaefer, Herzogenaurach (DE); Marco Hildebrand, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 92 days.

(21) Appl. No.: 15/027,861

(22) PCT Filed: Sep. 9, 2014

(86) PCT No.: PCT/DE2014/200458
§ 371 (c)(1),
(2) Date: May 16, 2016

(87) PCT Pub. No.: WO2015/051789
PCT Pub. Date: Apr. 16, 2015

(65) Prior Publication Data

US 2016/0251986 A1 Sep. 1, 2016

(30) Foreign Application Priority Data

Oct. 8, 2013 (DE) ..... 10 2013 220 220

(51) Int. Cl.
*F01M 11/02* (2006.01)
*F01L 1/352* (2006.01)
(Continued)

(52) U.S. Cl.
CPC ..... *F01L 1/352* (2013.01); *F01M 9/108* (2013.01); *F01L 2001/34423* (2013.01);
(Continued)

(58) Field of Classification Search
CPC ..... F01L 2001/34423; F01L 2001/3521; F01L 2810/02; F01M 9/102; F01M 9/105
(Continued)

(56) References Cited

U.S. PATENT DOCUMENTS

2003/0070643 A1 4/2003 Watanabe et al.
2005/0103299 A1* 5/2005 Schafer ..... F01L 1/352 123/90.17
(Continued)

FOREIGN PATENT DOCUMENTS

DE 102005018956 A1 11/2006
DE 102005059860 A1 7/2007
(Continued)

*Primary Examiner* — Jorge Leon, Jr.
(74) *Attorney, Agent, or Firm* — Simpson & Simpson, PLLC

(57) ABSTRACT

A camshaft adjusting device having improved lubricant management including adjusting gearing for adjusting the angular position of a camshaft is proposed, the adjusting gearing having an input shaft, which can be coupled to a crankshaft, an output shaft, which can be coupled to the camshaft and an adjusting shaft, which can be coupled to an actuator. The adjusting gearing defines a rotational axis and the gearing forms a gearing interior, in which the input shaft, the output shaft and the adjusting shaft are operatively interconnected. The camshaft adjusting device has a lubricant supply for supplying the gearing interior with a lubricant and the lubricant supply is designed to form a lubricant sump in the gearing interior, the sump being radially outwards situated relative to the rotational axis.

7 Claims, 5 Drawing Sheets

(51) Int. Cl.
*F01M 9/10* (2006.01)
*F01L 1/344* (2006.01)

(52) U.S. Cl.
CPC ... *F01L 2001/3521* (2013.01); *F01L 2810/02* (2013.01); *F01M 9/102* (2013.01); *F01M 9/105* (2013.01)

(58) Field of Classification Search
USPC ..... 123/90.15, 90.17, 90.34
See application file for complete search history.

(56) References Cited

U.S. PATENT DOCUMENTS

| | | | | |
|---|---|---|---|---|
| 2008/0308054 | A1* | 12/2008 | Kohrs ..... | F01L 1/34<br>123/90.17 |
| 2010/0180845 | A1 | 7/2010 | Kurisu et al. | |

FOREIGN PATENT DOCUMENTS

| | | | |
|---|---|---|---|
| DE | 102007000809 | A1 | 4/2008 |
| EP | 2400121 | A1 | 12/2011 |
| JP | H09250610 | A | 9/1997 |

* cited by examiner

CAMSHAFT ADJUSTING DEVICE

CROSS-REFERENCE TO RELATED APPLICATIONS

The present application is the United States National Stage Application pursuant to 35 U.S.C. §371 of International Patent Application No. PCT/DE2014/200458, filed on Sep. 9, 2014 and claims priority to German Patent Application No. 10 2013 220 220.2 filed on Oct. 8, 2013, which applications are incorporated by reference in their entireties.

FIELD OF THE INVENTION

The invention relates to a camshaft adjusting device.

BACKGROUND OF THE INVENTION

Camshaft adjusting devices are used for the adjustment of the angular position of the crankshaft relative to the camshaft of an internal combustion engine. Such camshaft adjusters typically comprise a drive member, which is coupled to the crankshaft by means of, for example, a chain or a belt; an output member, which is usually coupled to the camshaft in a torsion proof manner; and an adjusting shaft, which makes it possible to adjust an angular position of the output member relative to the drive member.

The drive shaft, the adjusting shaft and the output shaft come into operative connection with each other in a transmission, so that the net result is mechanical friction in the transmission due to the bearing arrangements and the mutual engagement. In order to reduce the mechanical friction, it is customary to lubricate the transmission of the camshaft adjuster with oil.

For example, the publication DE 10 2005 059 860 A1 discloses a lubricant circuit of a camshaft adjuster. In the lubricant circuit a lubricant is fed to the camshaft adjuster by way of the camshaft and is discharged again through the outlet ports that are located radially on the outside. In order to control the amount of lubricant in the camshaft adjuster and to avoid flooding the camshaft adjuster, it is proposed to form a flow element in a flow channel, which acts as a throttle or a diaphragm, in order to adjust the lubricant flow.

SUMMARY OF THE INVENTION

The object of the present invention is to propose a camshaft adjusting device that exhibits an improved lubricant management.

This engineering object is achieved by means of a camshaft adjusting device exhibiting the features disclosed in the patent claims. Preferred or advantageous embodiments of the invention will be apparent from the dependent claims, the following description and the accompanying figures.

A camshaft adjusting device, which is designed, in particular, for an engine, especially for an internal combustion engine, of a vehicle, is proposed within the scope of the invention. Optionally, the camshaft adjusting device comprises a camshaft, wherein the camshaft is designed to control the valves of the engine.

The camshaft adjusting device has a variator, wherein in this case it is particularly preferred that said variator be designed as a triple shaft transmission. The variator comprises an input shaft, an output shaft and an adjusting shaft. The input shaft can be coupled, for example, to the crankshaft of the motor by means of a chain or a belt. The output shaft is preferably coupled or can be coupled to the camshaft in a torsion proof manner. In particular, the input shaft forms a drive member; and the output shaft, an output member. In contrast, the adjusting shaft can be coupled or is coupled to an actuator. The actuator can be arranged with respect to the motor in such a way that it is rigidly mounted in the housing or can be arranged to rotate with said motor. The actuator may be implemented, for example, as a motor, in particular, an electric motor or as a brake. Optionally the camshaft adjusting device comprises the actuator.

The variator is designed to adjust an angular position of the camshaft. In particular, the variator is designed to change the angular position of the camshaft relative to the angular position of a crankshaft of the engine. As an alternative or in addition, the variator is designed to adjust the angular position between the input shaft and the output shaft. By adjusting the angular position it is preferably possible to move the opening times and/or closing times of the valves of the engine in the direction of "early" or "late."

The variator, in particular, the input shaft and/or the output shaft and/or the adjusting shaft define(s) a common axis of rotation of the variator.

The variator forms an internal gear chamber, wherein the input shaft, the output shaft and the adjusting shaft come into operative connection with each other in the internal gear chamber. In particular, the variator is designed as a summation transmission, wherein in this case it is particularly preferred that a rotary motion of the adjusting shaft be added to the rotary motion of the input shaft; and in this way the angular position is adjusted.

The camshaft adjusting device, in particular, the variator, has a lubricant supply unit for supplying the internal gear chamber with a lubricant. In particular, the lubricant is designed as an oil, especially as a transmission oil. The lubricant supply unit is designed as a continuous supply unit, so that the lubricant is continuously supplied to and removed from the internal gear chamber.

It is proposed within the scope of the invention that the lubricant supply unit be designed to form a lubricant sump, in particular, a lubricant jacket, which is disposed radially outside of the axis of rotation, in the internal gear chamber. In other words, the lubricant supply unit is dimensioned in such a way that the lubricant sump is formed in an annular space around the axis of rotation by the lubricant for lubricating the variator. It is particularly preferred that when the camshaft adjusting device is running, the lubricant sump be constant, in particular, in relation to the radial extension. In particular, the lubricant sump is designed so as to be speed independent of the radial expansion in the normal operating mode of the camshaft adjusting device, thus, for example, when the engine is running in idle or at higher operating speeds of the engine. In particular, when the system is running, the lubricant sump assumes a design specified target state that is speed independent. It is particularly preferred that the variator be designed in such a way that the input shaft, the output shaft and/or the adjusting shaft draw(s) lubricant from the lubricant sump and distribute(s) the lubricant in the internal gear chamber.

As a result, the invention takes a different approach to supplying lubricant to the variator. In this case the lubricant supply unit ensures that during the normal operating mode there is always a radially external lubricant sump that makes sure that the variator is undersupplied and at the same time oversupplied with the lubricant. It is particularly preferred that when the camshaft adjusting device, in particular, the variator, is running, the lubricant sump is designed to be constant.

In order to emphasize the inventive idea, it is claimed that the lubricant sump is formed due to flywheel forces, in particular, centrifugal forces that act on the lubricant. The centrifugal forces are generated by the rotation of the variator or parts thereof. It is particularly preferred that in the normal operating mode the variator rotates, on average, at an angular velocity that corresponds to the angular velocity of the input shaft and/or the output shaft. Rotating the variator at this average angular velocity has the effect of generating the centrifugal force, which in turn results in the lubricant sump being generated.

In a preferred embodiment of the invention the lubricant sump is dimensioned in the radial extent in such a way that at least one sliding bearing point and/or at least one rolling bearing point and/or at least one engagement point between two of the three shafts is and/or are covered with lubricant, where in this case the three shafts are formed by the input shaft, the output shaft and the adjusting shaft. This design emphasizes the aspect that it is not absolutely necessary to arrange all of the friction relevant points in the variator in the lubricant sump, because the relative motion of the three shafts in relation to each other causes the lubricant to be drawn from the lubricant sump and to be distributed in the variator, in particular, in the internal gear chamber. The lubricant level and, thus, the radial position of the inner surface of the lubricant sump has to be selected, in particular, in such a way that, on the one hand, the transmission members and the bearing arrangements are sufficiently immersed in the lubricant sump, but, on the other hand, it is possible to avoid unnecessary churning losses due to a lubricant level that is too high.

In a particularly preferred embodiment of the invention the lubricant supply unit comprises a lubricant feed line and a lubricant discharge line, where in this case the lubricant discharge line comprises a lubricant overflow, which defines the radial expansion of the lubricant sump in the direction of the axis of rotation. As a result, the lubricant overflow ensures that the internal gear chamber is not inundated with the lubricant. The lubricant overflow can be designed by choice, in particular, as one or more outlet ports out of the internal gear chamber, in particular, as an outlet gap out of the internal gear chamber. For example, the lubricant overflow is designed as at least one outlet port, oriented in the axial direction, out of the internal gear chamber. For example, in open systems, as used, for example, in chain drives, the lubricant overflow may lead into the chain case, so that the lubricant can flow out and can be returned there into the oil circuit. In closed systems, for example, in the case of belt drives, it is possible to provide, for example, return lines in the cylinder head of the motor.

It is particularly preferred that the lubricant discharge line exhibit a lubricant outflow, where in this case the lubricant outflow is designed radially outside of the lubricant sump. The lubricant outflow ensures that, for example, the unwanted dirt particles or other impurities in the lubricant do not permanently settle in the internal gear chamber, but rather are removed from the radially external bottom of the lubricant sump through the lubricant outflow out of the internal gear chamber, in particular, are flooded out through the lubricant outflow. For example, the lubricant outflow may be implemented as one or more outlet ports, extending in the radial direction, and/or as one or more outlet ports, extending in the axial directions. It is particularly preferred that the variator comprise a plurality of outlet ports as the lubricant outflow, with the outlet ports being preferably distributed at regular intervals in the circumferential direction about the axis of rotation. Preferably an intermediate angle between the outlet ports of the lubricant outflow is selected so as to be smaller than 60°, in particular, less than 50°. The distribution in the direction of rotation makes it possible to achieve that the lubricant can run off automatically through the lubricant outflow when the variator has stopped running. On the one hand, this arrangement has the advantage that after the variator has been shut down for a prolonged period of time, no uncooled, and, as a result, viscous or sticky lubricant remains in the variator and/or that the lubricant does not accumulate in an angle segment of the variator, thus producing in this way an imbalance when the variator is started up again.

In the configuration of the lubricant supply unit it is preferred that the volumetric flow rate QZ of the lubricant in the lubricant feed line be designed to be preferably on average greater than the volumetric flow rate QA of the lubricant outflow, so that QZ>QA holds true. In this way it is ensured that when the camshaft adjusting device is running, the lubricant accumulates in the internal gear chamber; and that the lubricant sump is formed. It is particularly preferred that the lubricant supply unit be adjusted in such a way that QA≤0.9*QZ holds true. The volumetric flow rates may be checked, for example, by means of a standardized test procedure; and, in so doing, a differential pressure of 5 bar and an oil viscosity of 30 cSt, for example, are reached.

In addition, it is, however, preferred that the sum of the mass flows of the lubricant outflow QA and the lubricant overflow QU be preferably designed to be on average greater than or equal to the volumetric flow rate of the lubricant feed line QZ, so that QA+QU≥QZ holds true. In this way both the formation of the lubricant sump as well as its limit in the radial direction is ensured radially inwards in the direction of the axis of rotation.

When viewed in terms of design, the lubricant feed line may be assigned a radius RZ; the lubricant outflow, a radius RA; and the lubricant overflow may be assigned a radius RU in relation to the axis of rotation. In order to form the lubricant sump in the manner described, it is preferred that RZ<RU<RA hold true.

In the event that there are a plurality of ports in the lubricant outflow, the lubricant overflow and the lubricant feed line, an average radius is used; and this radius can be calculated, for example, according to the following formula:

$$R=(1/A)\cdot\int r\cdot A(r)\cdot dr$$

where

R averaged radius, thus, RZ, RU or RA

A total area of the respective ports, thus, AZ, AU, AA r radius as the distance from the axis of rotation A(r) radius dependent area of the respective ports Taking into consideration the notations that have been introduced, but independently of the formula, it is preferred that the total area AZ of the ports of the lubricant feed lines into the internal gear chamber and the total area AA of the ports of the lubricant outflow out of the internal gear chamber satisfy the following relation:

$$AA\leq 0.9*AZ.$$

Furthermore, it is preferred that the total area AZ of the ports of the lubricant feed lines into the internal gear chamber and the total area AU of the ports of the lubricant overflow out of the internal gear chamber satisfy the following relation:

$$AU\geq 2.0*AZ.$$

In this case it is preferably assumed that the total areas form in each instance the size of the lubricant feed line and the lubricant outflow, respectively, with the size determining the volumetric rate of flow.

In principle, the variator may be designed as a swashplate gear mechanism, an eccentric gear mechanism, a planetary gear unit, a cam gear mechanism, a multi-articulated gear mechanism or coupled gear mechanism respectively, a friction gear mechanism, a helical gear mechanism with a threaded spindle as the speed increasing stage or as a combination of individual designs in a multi-stage design.

In a particularly preferred embodiment in terms of design, the variator is designed as a wave gear, where in this case said wave gear comprises a rolling bearing and a deformable steel bushing, which has external gear teeth and which is disposed on the rolling bearing. It is particularly preferred that the lubricant sump be installed in such a way that the rolling bearing with the outer ring, but not with the inner ring, and/or the steel bushing is and/or are immersed at least in sections in the lubricant sump. In this preferred embodiment the rapidly rotating component, i.e. the inner ring, of the rolling bearing, is kept out of the lubricant, so that the lubricant sump is not disrupted by churning losses. However, it is ensured by the immersion of the outer ring or the steel bushing that sufficient lubricant is fed to the rolling bearings and, as a result, also to the inner ring.

In particular, it should hold true for the radius of the inner ring Ri in relation to the radius RU of the ports of the lubricant overflow:

$$Ri \leq 0.9 * RU.$$

In a specific embodiment of the invention it is provided that the lubricant is fed through the axially extending passage ports in the camshaft, with said passage ports terminating in the radius RZ in the internal gear chamber. Furthermore, it is preferably provided that the lubricant outflow is designed as a plurality of outlet ports, which extend in the axial direction and which are located at the level of the outermost region of a bearing arrangement between the input shaft and the output shaft in the internal gear chamber. Furthermore, it is preferably provided that the lubricant overflow is designed as a plurality of outlet ports or as a circumferential, preferably continuous lubricant gap, with said outlet ports or lubricant gap being disposed with respect to the radius RU between the inner ring and the outer ring of the rolling bearing.

DESCRIPTION OF THE DRAWINGS

Additional features, advantages and effects of the invention will become apparent from the following description of preferred exemplary embodiments of the invention as well as the accompanying figures, in which.

DETAILED DESCRIPTION OF THE INVENTION

Figure 1:
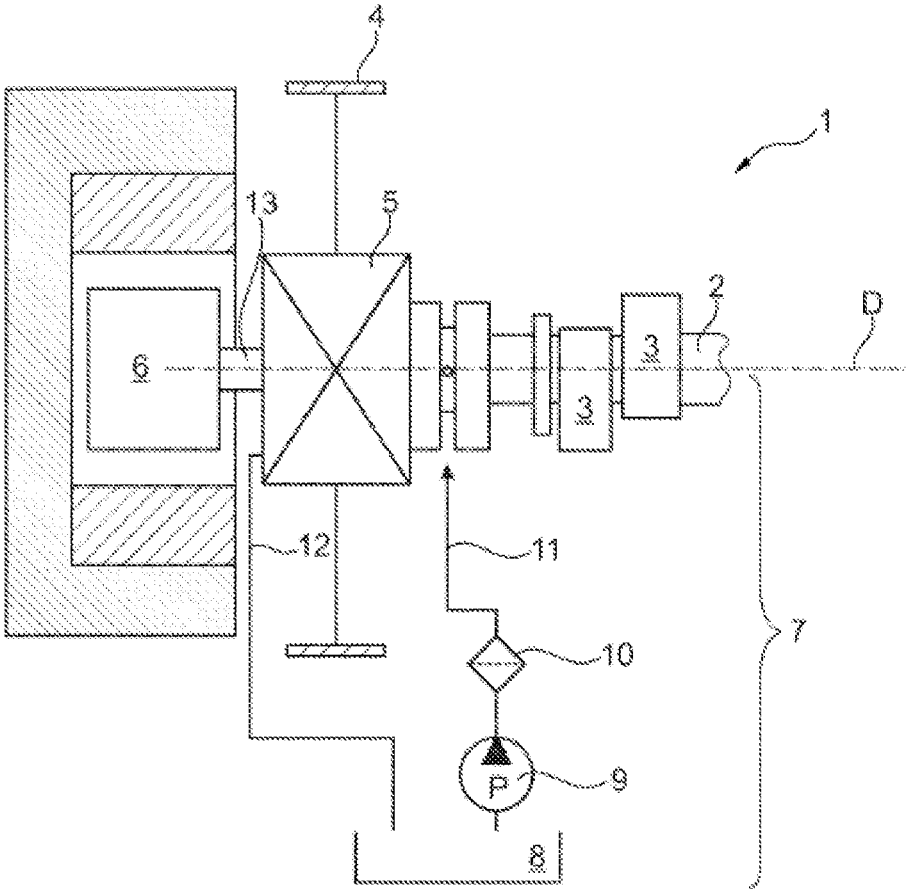
FIG. 1 is a schematic diagram of a camshaft adjusting device according to one exemplary embodiment of the invention.

FIG. 1 shows in a diagrammatic representation a camshaft adjusting device 1 for an engine, in particular, an internal combustion engine of a vehicle, as a first exemplary embodiment of the invention. The camshaft adjusting device 1 comprises a camshaft 2, which has a plurality of cams 3, which are designed to actuate the valves of the engine.

The drive of the camshaft 2 is provided by way of a drive gear 4, which is coupled to a crankshaft (not shown) of the engine by means of a chain, a belt or a transmission. A variator 5 is interposed between the drive gear 4 and the camshaft 2. Said variator allows an angular adjustment of the camshaft 2 to be effected in a controlled fashion relative to the drive gear 4 and, as a result, relative to the crankshaft (not shown). In order to control the variator 5, this variator is coupled to an electric motor 6 by means of a motor shaft 13, which is arranged so as to be stationary relative to the variator 5. That is, said motor shaft does not rotate along with said variator.

The camshaft adjusting device 1 comprises a lubricant supply unit 7, which introduces, starting from an oil pan or more specifically an oil tank 8, transmission oil as a lubricant into the camshaft 2 through a motor oil pump 9 and optionally a motor oil filter 10 by means of a rotary transmitter (not shown) for oil. The lubricant is fed through a lubricant feed line 11 from the camshaft 2 into the variator 5, in order to lubricate the variator 5 and is then discharged again from the variator 5 through a lubricant discharge line 12, so that the lubricant supply unit 7 is designed as a lubricant circuit.

Figure 2:
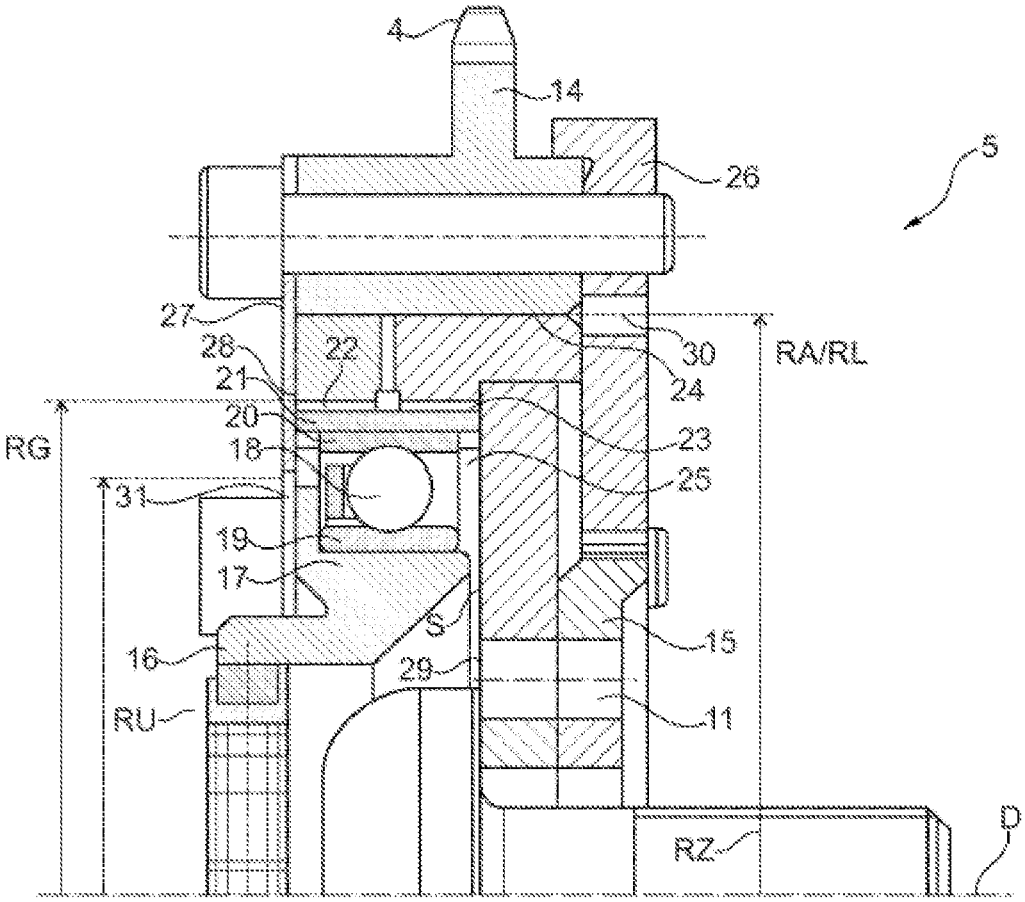
FIG. 2 is a cross-sectional view of the variator of the camshaft adjusting device in FIG. 1.

FIG. 2 shows the variator 5 in a cross-sectional view taken along an axis of rotation D, which is defined, for example, by the camshaft 2 or the motor shaft 13 (FIG. 1).

The variator 5 is also designed as a so-called wave gear (also called a harmonic drive gear). The wave gear 5 is also referred to as an ellipto-centric gear or in English a strain wave gear (SWG). The variator 5 has an input shaft 14, which is coupled in a torsion proof manner to the drive gear 4 or is formed by this drive gear. Furthermore, the variator 5 has an output shaft 15, which is connected to the camshaft 2 in a torsion proof manner. In contrast, an adjusting shaft 16 is connected to the motor shaft 13 in a torsion proof manner. The adjusting shaft 16 has a generator section 17, which has a cross section that is perpendicular to the axis of rotation D and which is designed so as to be not round, in particular, is designed to be elliptical. A rolling bearing 18 is disposed on said generator section in such a way that the inner ring 19 of the rolling bearing 18 rests on a shell surface of the generator section 17; and the outer ring 20 bears a deformable, cylindrical steel bushing 21 with external gear teeth. The steel bushing 21 is also referred to as a flex spline. The steel bushing 21 is designed with a cross section, which is perpendicular to the axis of rotation D, and is designed elliptical as well.

The input shaft 14 bears internal gear teeth 22, which mesh with the external gear teeth of the steel bushing 21. Even the output shaft 15 bears internal gear teeth 23, which also mesh with the external gear teeth of the steel bushing 21. By rotating the adjusting shaft 16 at an angular velocity that is different from the angular velocity of the input shaft 14 it is possible to adjust the input shaft 14 and the output shaft 15 in terms of the angular position to each other. Such a harmonic drive gear is also described, for example, in the publication DE 10 2005 018 956 A1.

The input shaft 14, the output shaft 15 and the adjusting shaft 16 come into operative connection in an interaction region 28 in a radius RG by means of the internal gear teeth 22, 23 and the external gear teeth of the steel bushing 21. In addition, the variator 5 has a sliding bearing section 24 in a radius RL between a carrier of the internal gear teeth 23 of the output shaft 15 and the input shaft 14.

The variator 5 forms an internal gear chamber 25, which is formed by the input shaft 14, on the one hand, by a supporting member 26 and, on the other hand, by a cover 27, where in this case the rolling bearing 18 and the interaction region 28 of the external gear teeth of the steel bushing 21 and the internal gear teeth 22 and 23 are disposed in the internal gear chamber 25 of the sliding bearing section 24.

The lubricant feed line 11 comprises one or more axially oriented outlet ports 29, which are arranged on an end face S of the output shaft 15 at a distance RZ from the axis of rotation D. The outlet ports 29 are supplied with lubricant through the channels in the camshaft 2. In the normal operating mode the lubricant issues from the outlet ports 29 and is distributed in the internal gear chamber due to the rotation of the output shaft 15, where in this case the end face S acts as a lubricant guide surface. The lubricant is fed through the outlet ports 29 into the internal gear chamber 25.

The lubricant discharge line 12 is divided into a lubricant outflow 30 and a lubricant overflow 31. The lubricant outflow 30 is located at a distance RA from the axis of rotation D. The lubricant overflow 31 is disposed at a distance RU from the axis of rotation D.

Figure 3:
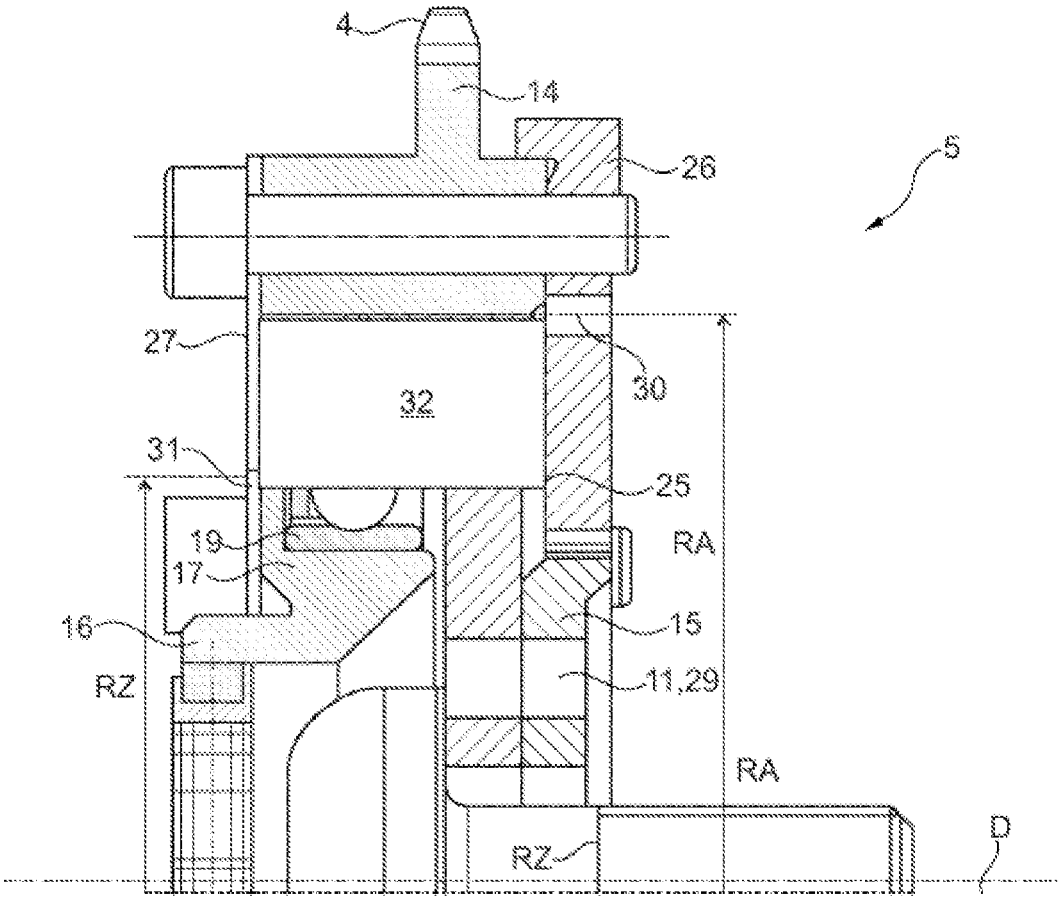
FIG. 3 is the same view as in FIG. 2 the variator with a lubricant sump.

The outlet ports 29, the lubricant outflow 30 and the lubricant overflow 31 as well as the distances RA, RZ and RU are dimensioned in such a way that a lubricant sump 32 is formed in the internal gear chamber 25, as is shown in a highly schematic form in FIG. 3, superimposed on the cross sectional view of the variator 5. It can be seen that the lubricant sump 32 extends from the radial outer side of the internal gear chamber 25 up to a radially outer edge of the lubricant overflow 31. The sliding bearing section 24 as well as the interaction region 28 of the internal gear teeth 22, 23 and the external gear teeth of the steel bushing 21 and the outer ring 20 of the rolling bearing 18 are disposed in this region of the lubricant sump 32. Thus, by generating the lubricant sump 32 it is ensured that both the sliding bearing section 24 and the interaction region 28 are supplied with sufficient lubricant. In contrast, the inner ring 18 is arranged outside of the lubricant sump 32, in order to avoid unnecessary churning of the lubricant.

If the volumetric flow rates of the lubricant supply unit 7 are taken into consideration, then the volumetric flow rate QZ of the lubricant feed line 11 is adjusted by the configuration of the outlet ports 29 and other flow-relevant components in such a way that said volumetric flow rate is always less than or equal to the volumetric flow rate of the lubricant discharge line 12 that is made up of the volumetric flow rate QA of the lubricant outflow 30 and the volumetric flow rate QU of the lubricant overflow 31.

In particular, it is provided that the volumetric flow rate QA of the lubricant outflow 30 is less than the volumetric flow rate QZ of the lubricant feed line 11. In this way it is ensured in the normal operating mode that, first, the lubricant sump 32 is filled until it reaches the radially outer edge of the lubricant outflow 30 and then flows out with certainty, so that an overflow of the internal gear chamber 25 is prevented. This arrangement achieves the objective that when the variator 5 is running, the radial expansion of the lubricant sump 32 is always constant, irrespective of the angular velocity of the input shaft 14.

Figure 4:
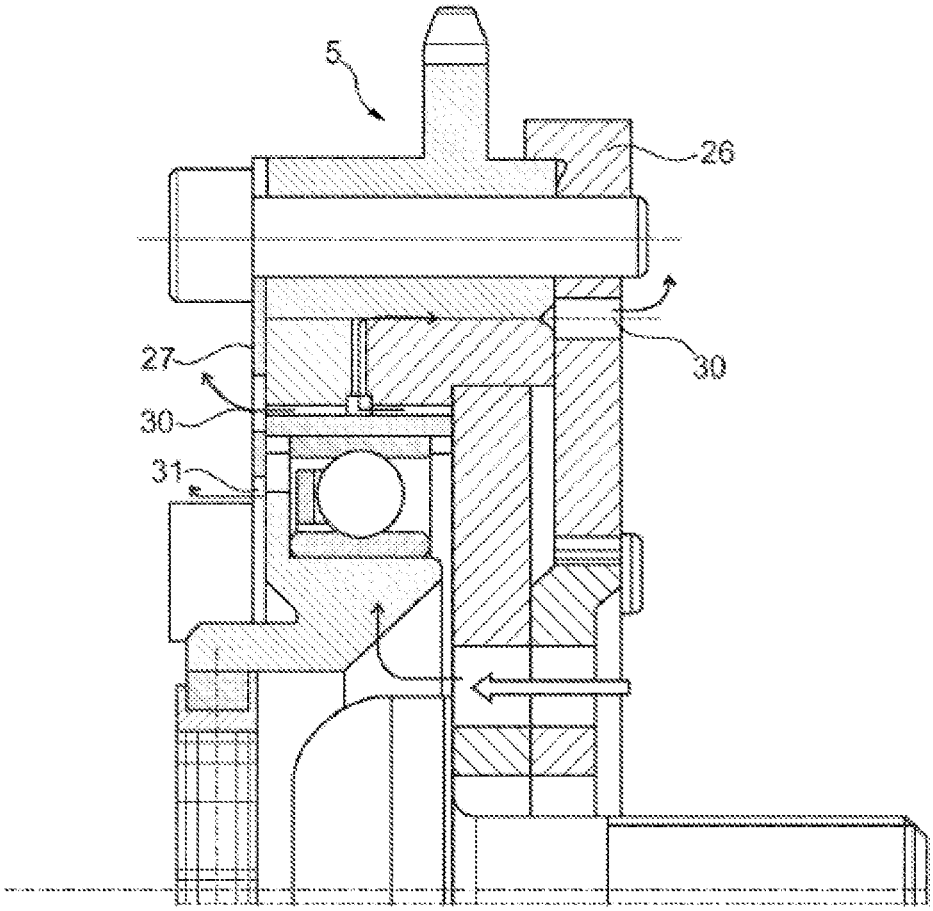
FIG. 4 is an alternative embodiment of the variator in FIG. 2.

FIG. 4 shows an additional exemplary embodiment of the variator 5, where, in contrast to the exemplary embodiment in the preceding figures, the lubricant outflow 30 is divided into two different axial outflow ports, with one of the outflow ports being disposed in the supporting member 26 and the other outflow port being disposed in the cover 27. The flow of the lubricant is indicated in schematic form by the arrows.

Figure 5:
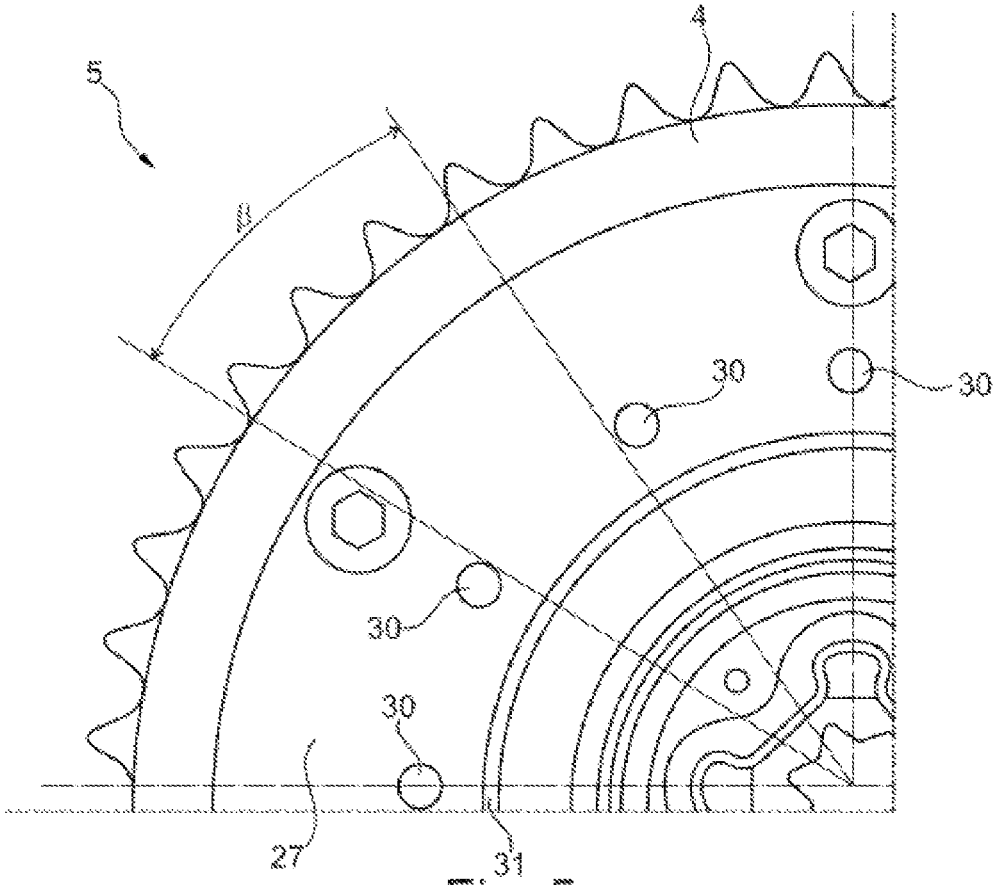
FIG. 5 is a plan view of the variator in FIG. 4.

FIG. 5 shows a plan view of the variator 5, in order to illustrate the external ports of the lubricant discharge line 12. The lubricant outflows 30, which are provided as passage ports out of the internal gear chamber 25, for example, into a chain case of the motor, can be seen in the circumferential direction. An intermediate angle beta is provided in each instance between the passage ports of the lubricant outflows, so that the internal gear chamber 25 may idle when the variator 5 is shut down. In contrast, the lubricant overflow 31 is designed as an annular gap between the cover 27 and a circular collar of the generator section 17.

The variables of the variator 5 satisfy preferably at least one condition or any selection of the following conditions or all of the following conditions:

RZ<RU<RA.

RA≥1.00*RG and/or RA≥1.00*RL, in particular, RA≥1.05*RG and/or RA≥1.05*RL.

QZ>QA, preferably 0.9*QZ>QA.

The total area AA of the ports of the lubricant outflow 30 is less than the total area of the AZ of the outlet ports 29 of the lubricant feed line 11, in particular, AA≤0.9*AZ holds true.

The total area AU of the ports of the lubricant overflow 31 is greater than the total area of the AZ of the outlet ports 29 of the lubricant feed line 11, in particular, AU≥2.0*AZ holds true.

QU>QZ−QA, where QZ=QA+QU holds true.

Ri≥1.0*RU, preferably Ri≤0.9*RU.

LIST OF REFERENCE NUMERALS

| | |
|---|---|
| 1 | camshaft adjusting device |
| 2 | camshaft |
| 3 | cam |
| 4 | drive gear |
| 5 | variator |
| 6 | electric motor |
| 7 | lubricant supply unit |
| 8 | oil tank |
| 9 | motor oil pump |
| 10 | motor oil filter |
| 11 | lubricant feed line |
| 12 | lubricant discharge line |
| 13 | motor shaft |
| 14 | input shaft |
| 15 | output shaft |
| 16 | adjusting shaft |
| 17 | generator section |
| 18 | rolling bearing |
| 19 | inner ring |
| 20 | outer ring |
| 21 | steel bushing |
| 22 | internal gear teeth |
| 23 | internal gear teeth |
| 24 | sliding bearing section |
| 25 | internal gear chamber |
| 26 | supporting member |
| 27 | cover |
| 28 | interaction region |
| 29 | axially oriented outlet ports |
| 30 | lubricant outflow |
| 31 | lubricant overflow |
| 32 | lubricant sump |
| D | axis of rotation |
| QA, QU, QZ | volumetric flow rates |
| RA, RZ, RO, RG, RL | radii |
| AA, AZ, AU | total areas |

What is claimed is:

1. A camshaft adjusting device, comprising:

a variator, wherein the variator has an input shaft, arranged to be coupled to a crankshaft;

an output shaft, arranged to be coupled to a camshaft;

an adjusting shaft, arranged to be coupled to an actuator, wherein the variator forms an internal gear chamber, wherein the input shaft, the output shaft and the adjusting shaft are in operative connection with each other in the internal gear chamber; and, a lubricant supply unit for supplying the internal gear chamber with a lubricant;

wherein:

the lubricant supply unit forming a lubricant sump, which is arranged radially outside of an axis of rotation, in the internal gear chamber;

the lubricant sump covers at least one rolling bearing point; and, the lubricant supply unit has a lubricant feed line and a lubricant discharge line, wherein the lubricant discharge line comprises a lubricant overflow, wherein a radial expansion of the lubricant sump is defined radially inwards by the lubricant overflow in such a way that an outer ring of a rolling bearing is arranged in a region of the lubricant sump; and an inner ring is arranged outside of the lubricant sump.

2. The camshaft adjusting device of claim 1, wherein the lubricant overflow is arranged as an outlet port out of the internal gear chamber.

3. The camshaft adjusting device of claim 1, wherein the lubricant discharge line has a lubricant outflow, wherein said lubricant outflow is arranged radially outside of the lubricant sump.

4. The camshaft adjusting device of claim 3, wherein a volumetric flow rate of the lubricant feed line is greater than a volumetric flow rate of the lubricant outflow, so that the lubricant sump is formed.

5. The camshaft adjusting device of claim 4, wherein a sum of mass flow rates of the lubricant outflow and the lubricant overflow is greater than or equal to the volumetric flow rate of the lubricant feed line, so that the lubricant sump is defined inwards in a radial direction by the lubricant overflow.

6. The camshaft adjusting device of claim 3, wherein the lubricant feed line includes a first radius, the lubricant outflow includes a second radius, and the lubricant overflow includes a third radius in relation to the axis of rotation, where the first radius is smaller than the third radius which is smaller than the second radius.

7. The camshaft adjusting device of claim 1, wherein the variator comprises a harmonic drive, wherein the harmonic drive includes the rolling bearing and a deformable steel bushing, which has external gear teeth and which is arranged on the rolling bearing, wherein the rolling bearing and/or the steel bushing is/are immersed at least in sections in the lubricant sump.

* * * * *